US006422403B1

(12) United States Patent
Woolnough et al.

(10) Patent No.: US 6,422,403 B1
(45) Date of Patent: Jul. 23, 2002

(54) DISPLAY APPARATUS

(75) Inventors: Andrew Charles Woolnough, Gravesend; Jean Wilhelmine Harris, Winnersh; Sydney James Harris, Nr. Basingstoke, all of (GB)

(73) Assignee: EML Limited, Berkshire (GB)

( * ) Notice: Subject to any disclaimer, the term of this patent is extended or adjusted under 35 U.S.C. 154(b) by 0 days.

(21) Appl. No.: 09/586,434

(22) Filed: Jun. 2, 2000

(30) Foreign Application Priority Data

Mar. 3, 2000 (GB) ..... 0005115

(51) Int. Cl.[7] ..... B42F 7/12
(52) U.S. Cl. ..... 211/55; 211/130.1; 40/124
(58) Field of Search ..... 211/130.1, 128.1, 211/55; 248/250, 225.21; 40/124, 124.2, 124.4

(56) References Cited

U.S. PATENT DOCUMENTS

| | | | | |
|---|---|---|---|---|
| 2,886,182 A | * | 5/1959 | Dauman | 211/55 |
| 3,198,340 A | * | 8/1965 | Tokash | 211/55 X |
| 4,149,630 A | | 4/1979 | Transport | |
| 4,598,504 A | * | 7/1986 | Itagaki | 211/87.01 X |
| 4,613,047 A | | 9/1986 | Bushyhead et al. | 211/55 |
| 4,630,731 A | | 12/1986 | Albery | |
| 4,796,764 A | | 1/1989 | Hardy | 211/184 |
| 4,892,198 A | | 1/1990 | Johnson | 211/41 |

FOREIGN PATENT DOCUMENTS

| | | |
|---|---|---|
| DE | 478143 | 7/1936 |
| DE | 516656 | 7/1938 |
| EP | A0 225 568 | 11/1986 |
| EP | A-0 295 859 | 6/1988 |
| EP | 0 344 830 | 12/1989 |
| EP | 0 442 730 A1 | 8/1991 |
| FR | 2.037.703 | 3/1970 |
| GB | 1 337 194 | 11/1973 |
| GB | 1 482 997 | 12/1974 |
| GB | 2 078 204 A | 1/1982 |
| GB | 2 121 273 A | 12/1983 |
| GB | 2 206 035 A | 12/1988 |
| GB | 2 241 155 A | 8/1991 |
| GB | 2 279 554 A | 1/1995 |
| GB | 2 293 538 A | 4/1996 |
| GB | 2 317 328 A | 3/1998 |
| WO | WO 96/16579 | 6/1996 |
| WO | WO 98/54688 | 12/1998 |

* cited by examiner

*Primary Examiner*—Daniel P. Stodola
*Assistant Examiner*—Erica B Harris
(74) *Attorney, Agent, or Firm*—Renner, Otto, Boisselle & Sklar, LLP

(57) ABSTRACT

A modular display having upper and lower modules connected to one another. Each module has an upstanding wall and is of L-shaped cross section. The upstanding wall of each lower module is secured to the protruding wall of the upper module below the upper edge of the wall. The upstanding walls are thus, in use, spaced from one another to define an open ended receptacle. The lower end of an upper module and an upper part of lower module have mutually engageable connector parts for connecting the modules together.

42 Claims, 4 Drawing Sheets

DISPLAY APPARATUS

The present application is an application filed in accordance with 35 U.S.C. §119 and claims the benefit of earlier filed United Kingdom application number GB 0005115.1 filed on Mar. 3, 2000.

FIELD OF THE INVENTION

This invention relates to a display apparatus, in particular but not exclusively for use in retail environments such as shops. The display apparatus of the invention may also be used e.g. in banks, hospitals, offices and indeed virtually anywhere that it is required to provide an attractive display of articles.

BACKGROUND OF THE INVENTION

EP-A-0 295 869 discloses a display apparatus intended primarily for the displaying of laminar articles such as cards, leaflets, sheets, brochures and magazines. EP-A-0 295 869 discloses a plurality of elongate channels, fabricated from a plastics material such as polycarbonate, suspended one below another. Each channel is of generally J-shaped cross section for supporting articles in the trough thereby formed.

Each J-shaped trough has a longer arm and a shorter arm. The apparatus includes a support for supporting each lower J-shaped channel on the next higher J-shaped channel. The support includes a hook, which is provided on the longer arm of each lower J-shaped channel and which hooks over the shorter arm of the next higher J-shaped channel whereby each lower J-shaped channel is suspended from the shorter, forward arm of the next higher J-shaped channel so as to provide a suspended tiered display.

The apparatus of EP-A-0 295 859 may be dismantled for transportation, storage and replacement. Nonetheless, the apparatus of EP-A-0 295 859 suffers numerous drawbacks. Primary amongst the drawbacks is the fact that each lower J-shaped channel is suspended from the shorter arm (i.e. the front arm) of the upwardly adjacent J-shaped channel. This means that, in order to provide a visually attractive display, all the J-shaped channels must have longer and shorter arms of the same respective lengths.

Also, the formation of the upper end of the longer arm of each J-shaped channel as a hook, that hooks over the shorter arm of the next upwardly adjacent J-shaped channel, means that some of the space, between the shorter and longer arms defining the trough for displaying articles, is occupied by the material of the hook. This limits the available distance between the front and rear arms, and hence the quantity of articles that can be displayed in the apparatus of EP-A-0 295 869. This is important when the articles displayed are, e.g. greeting cards.

Another disadvantage of the apparatus of EP-A-0 295 869 is that the longer wall of each lower J-shaped channel overlies the shorter wall of the next, upwardly adjacent channel. This means that the overlapping faces of the longer and shorter arms must be free of protuberances, otherwise the hook defined at the upper end of each longer arm cannot be successfully hung from the adjacent shorter arm.

It is also known to provide an apparatus (herein "the known display") that defines a cascading series of U-shaped channels. The upper edge of the rear limb of a lower said channel is connected to the underside of the next upwardly adjacent channel.

This arrangement solves the above-noted disadvantages of the display of EP-A-0 295 869, in that it permits production of a neat and attractive display even if the dimensions of the channel members (or parts thereof) differ from one tier of the display to the next.

The known display also permits the creation of visual effects in the apparatus, that appear not to be possible in the EP-A-0 295 869 apparatus. In particular, the upper edge of each front wall of each module is free. This in turn means that at least the front wall of the known display may be decorated e.g. by means of the addition of embellishments, or by virtue of having a non-rectilinear upper edge. The known display remains readily dismantleable and reassemblable.

However, the known display may require modification in order to display tall, flexible, items, such as magazines. This is because the upstanding front wall, of each U-shaped channel, that supports the upper parts of articles in the adjacent lower channel, is not generally tall enough to prevent magazines and similar articles from flopping over in the display. This is of course undesirable since in this condition the advertising effect of the magazine covers may be lost; the magazines may become damaged and unsaleable; and the stocked display is unsightly.

SUMMARY OF THE INVENTION

One possible modification to the known display is simply to deepen each U-shaped channel sufficiently, to support articles such as magazines and elongate leaflets. However this is associated with production difficulties. In particular, a molded or extruded comparatively deep U-section channel can go out of shape during cooling of the plastics material. This can lead to jamming of production equipment, and in any event can reduce the dimensional accuracy of the display to unacceptable levels.

According to the invention in a broad aspect there is provided an apparatus as defined in claim 1. A preferred feature of the shape of the apparatus is defined in claim 2. This apparatus enjoys the same advantages, over the apparatus of EPA-0 295 869, as the known apparatus. It additionally may be manufactured having dimensions(in particular, a height) suitable for supporting magazines and tall leaflets.

In preferred embodiments of the invention there is provided an apparatus as aforesaid including a further, lower module including a further, lower upstanding wall and a third protruding wall protruding therefrom, the further, lower upstanding wall being connectable, at a point below its uppermost edge, to the second protruding wall whereby, on connection of the third protruding wall and the further, lower, upstanding wall together, a portion of the further, lower, upstanding wall extends above the second protruding wall to define, with the walls of the first, lower module a further said channel, that is open along at least one edge for display and dispensing of articles therein.

Conveniently the apparatus includes a plurality of the further lower modules supported one beneath another, by virtue of connection of the upstanding wall of each lower module to the protruding wall of the adjacent, higher module, whereby to define a series of the preferably generally U or J-shaped modules one beneath another. Thus the display apparatus of the invention may be configured as a descending series of virtually any number of receptacles or channels that are suitable for supporting magazines, leaflets or similar articles.

Further, advantageous features of the invention are defined in the other dependent claims. Other claims define features that permit the ready connecting together, in a tiered display, of more than two of the modules of the apparatus. Still other claims define a terminating wall that with the lowermost module of the display or recess defines a lowermost U or J-shaped channel, for displaying more of the magazines or leaflets. Further claims define advantageous features of the terminating wall, that permit its ready attachment to the lowermost module of the display. Still further claims advantageously define means for supporting and bracing the apparatus relative to a fixed, preferably vertical surface such as a wall.

Preferably the upstanding wall of the or each lower module is generally parallel to the upstanding wall of the upwardly adjoining module when the modules are connected together. However, this need not necessarily be so.

The absence of any attachment involving the front of the upstanding wall of each module means that the upstanding wall may be made to any height to suit the application under consideration. This in turn provides the option of having differently sized modules within a single display, without any detrimental effect on the overall visual attractiveness of the display.

In another embodiment of the invention the upstanding walls of the respective modules are of generally equal heights. This allows the manufacture of a standard module size, that may be used to build up a tiered display of virtually any preferred depth. Obviously, a display apparatus may, if desired, include a mix of the aforesaid types of module.

Conveniently the upstanding wall of a said module may include ornamental features. An example of such an ornamental feature is that of a non-rectilinear free edge to the upstanding wall of a module. Thus, for example, the upper edge may include cut-outs or recesses to define a preferred image, pattern or message. Another possibility is for the front wall to include, e.g., indicia, embossments, apertures and/or recesses, to enhance the appearance of the display, display a message or for other purposes as disclosed hereinbelow. Other claims define a further feature that advantageously assists in the display of thin, laminar items. Still other claims define a moveable divider for sub-dividing the interior or the receptacle in more detail.

There now follows a description of preferred embodiments of the invention by way of non-limiting example with reference being made to the accompanying drawings in which:

DETAILED DESCRIPTION

Figure 1:
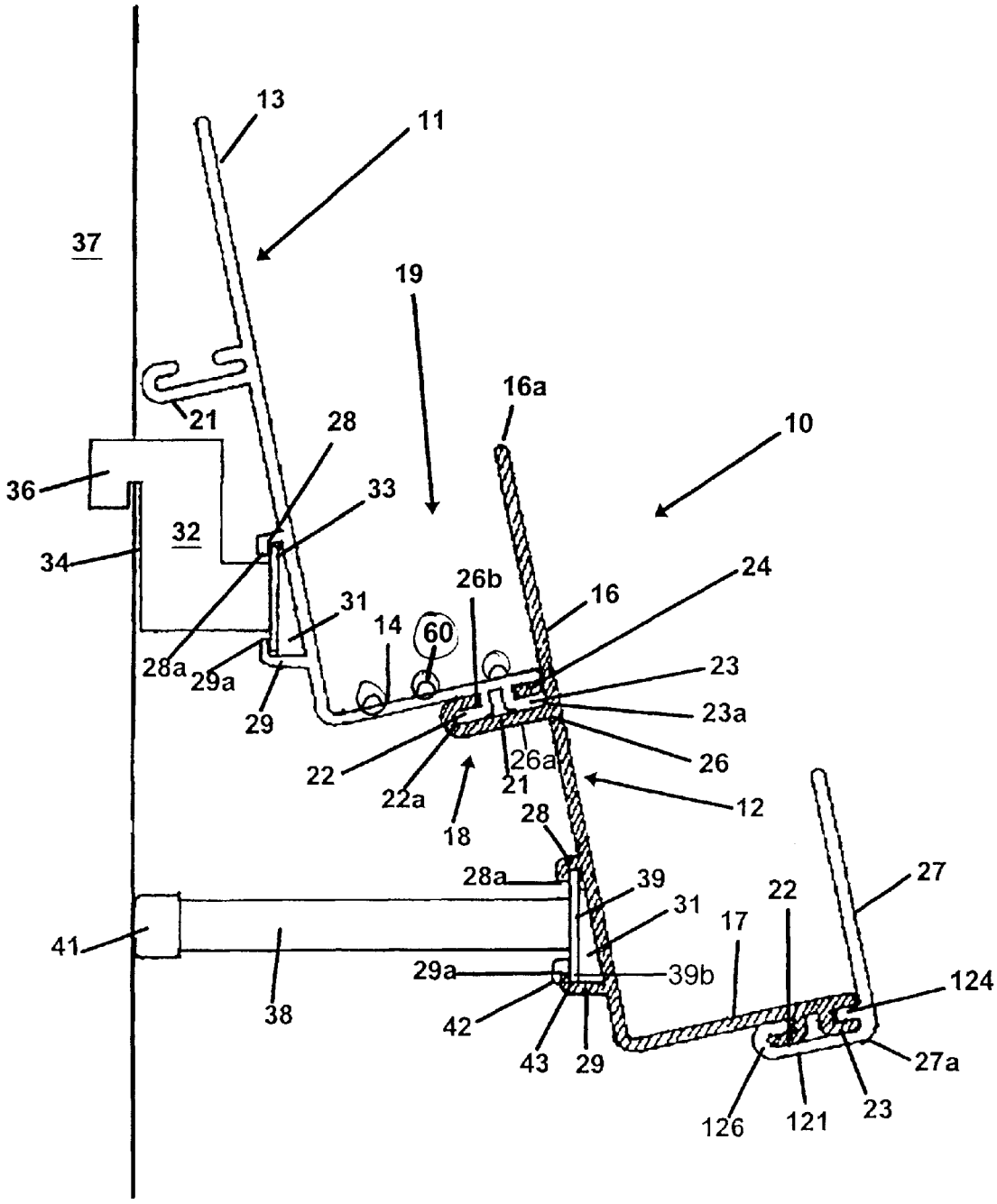
FIG. 1 is an end elevational view of a first embodiment of the invention.

Referring to the drawings there is shown a modular display apparatus 10 that in its simple form includes upper 11 and lower 12 modules joined together to define the display apparatus 10. Upper module 11 includes an upper upstanding wall 13 and, in the embodiment shown, protruding at right angles thereto a first protruding wall 14. Protruding wall 14 may in other embodiments protrude at other angles than the right angle shown. Lower module 12 is in the embodiment shown identical to upper module 11. Thus lower module includes a lower upstanding wall 16 and a second protruding wall 17 protruding at right angles to lower upstanding wall 16. Second protruding wall 17 may also protrude at angles other than ninety degrees.

Lower upstanding wall 16 is connected, at a point 18 on its rear face below its upper, free edge 16*a*, to the underside of first protruding wall 14. Thus the connected modules 11, 12 define a display apparatus 10 in which the portion of lower upstanding wall 16 protruding above connection 18 defines, with the walls 13, 14 of the upper module 11, a J-shaped channel 19 that is open along at least one edge. If the height of each upstanding wall 13, 16 and the width of each module 11, 12, in the direction perpendicular to FIG. 1, are sufficient, the resulting J-shaped channel 19 is suitable for displaying tall, flexible items, such as magazines, in an attractive way that minimizes damage to the articles. Since module 12 is identical to module 11, it includes part of a connector, such as connector 18, in the underside of second protruding wall 17.

Thus a further, lower upstanding wall may if desired be arranged to extend above the second protruding wall 17 and define, with the walls 16, 17 of module 12, a further J-shaped channel. In practice a downwardly extending series of the J-shaped channels may be formed by securing a series of the modules such as modules 11, 12 one beneath another in a manner analogous to the arrangement of modules 11, 12. The parts of the modules 11, 12 defining the connection 18 will now be described in more detail.

Connector 18 includes a slot 21 protruding from approximately half way down the rear face of each upstanding wall 13, 16. The underside of each protruding wall 14, 17 includes, protruding therefrom, a pair of members 22, 23 that are form-lockingly engageable with an adjacent slot 21 to connect the modules 11, 12 together. More specifically, both the slot 21 and the members 22, 23 are elongate in the direction perpendicular to the plane on FIG. 1, whereby on connection of the modules together each lower module is suspended from the adjacent upper module along most of or all its width.

As is visible in FIG. 1 the members 22, 23 define an essentially T-section arrangement; and the slot 21 is of a correspondingly sized T-section. The members 22, 23 are mutually parallel, elongate, L-section members 22, 23 spaced from one another and protruding downwardly from the undersides of the protruding walls 14, 17 to define the essentially T-section shape. This is achieved by virtue of divergence of the free limbs 22*a*, 23*a* of the L-sections from one another as shown.

The T-slot 21 is constituted by a first top wall 24 protruding at right angles from the rear side of each upstanding wall 14, 17; and, spaced below the first top wall 24, a J-section member 26 whose straight end 26*a* protrudes at right angles to the rear side. Consequently the free, curved end 26*b* of J-section member 26 is juxtaposed to and spaced laterally from the free end of the first top wall 24. Thus the members 24, 26 define the T-slot, with the portion of the J-section member 26 adjacent the end 26*b* defining a second top wall parallel to and spaced from first top wall 24. Thus the T-slot is open along its upper side, to accommodate the stems of the L-section members 22, 23.

Other means of connecting the modules together lie within the scope of the invention. For example, the essentially T-section member and the T-slot may be formed in other ways than those described herein. Also it is not essential to employ T-section members and slots to achieve the desired releasable connection between adjacent modules in a display 10. However, the components described herein provide firm support for suspended modules along the active width of a display 10, while also being easy to manufacture by extrusion.

Module 12 of FIG. 1 shows a means of terminating a cascade of the modules 11, 12 defining a display 10. This is through use of an upwardly extending end wall 27 that is secured to the underside of second protruding wall 17. Wall 27 is of comparable width to wall 17 in a direction perpendicular to the plane of FIG. 1. The lowermost end 27*a* of end wall 27 when secured to second protruding wall 17 extends only slightly lower than the underside of wall 17; whereas the top of wall 27 protrudes above wall 17 by a comparable distance to the extent of the protrusion of wall 16 above first protruding wall 14. Consequently end wall 27 defines, with the walls of module 12, a J-shaped channel.

Wall 27 includes, protruding at right angles to its lowermost end 27*a*, a T-slot arrangement 121 that in the embodiment shown is of the same construction as T-slot 21 described hereinabove. Thus T-slot 121 includes a first top wall 124 and a J-section member 126 arranged analogously to members 24 and 26. Consequently end wall 27 may be slid into engagement along its length with the L-section members 22, 23 extending along the underside of the module requiring termination by means of wall 27.

Although in FIG. 1 the end wall 27 is shown secured to the lowermost module of a pair 11, 12 of modules, it may of course be secured, in the manner described, to a display apparatus comprising any number of the modules suspended in a downwardly extending series. Also the T-slot 121 of wall 27 may if desired be formed in other ways than the one described. Indeed it is not essential that a T-slot per se be used for securing the end wall 27, numerous functional equivalents to the described T-slot being possible. However, a T-slot of the kind described herein has been found to be particularly suitable for manufacture by extrusion.

The display apparatus 10 is supported in use as follows: the rear surface of each upstanding wall 13, 16 has extending therefrom a pair of L-section members 28, 29 arranged so that a free end 28*a* of one of the members is juxtaposed to the free end 29*a* of the other member 29. The stem of each member 28, 29 is secured to the upstanding wall 13, 16 as appropriate, whereby the L-section members 28, 29 define a channel 31. The L-section members 28, 29 extend perpendicular to the plane of FIG. 1 for the width of the display apparatus 10, whereby the channel 31 extends for the same distance.

A support member 32 having a T-profile head 33 is slideably receivable in the channel 31 of the uppermost module 11 of a plurality of modules defining a display apparatus 10 according to the invention. Support member 32 includes, spaced rearwardly from channel 31, in use of the apparatus 10, a reaction surface 34; and, spaced rearwardly and upwardly from channel 31, a hook 36. Hook 36 is dimensioned to fit into, e.g., a standard size of shopfitting slot formed, e.g., in a rail 37 secured to a building wall. When support member 32 is hooked into a slot of the kind mentioned, and T-profile head 33 is slid into channel 31, the mass of at least the upper portion of apparatus 10 is supported in cantilever fashion, with reaction surface 34 in contact with rail 37.

Figure 4:
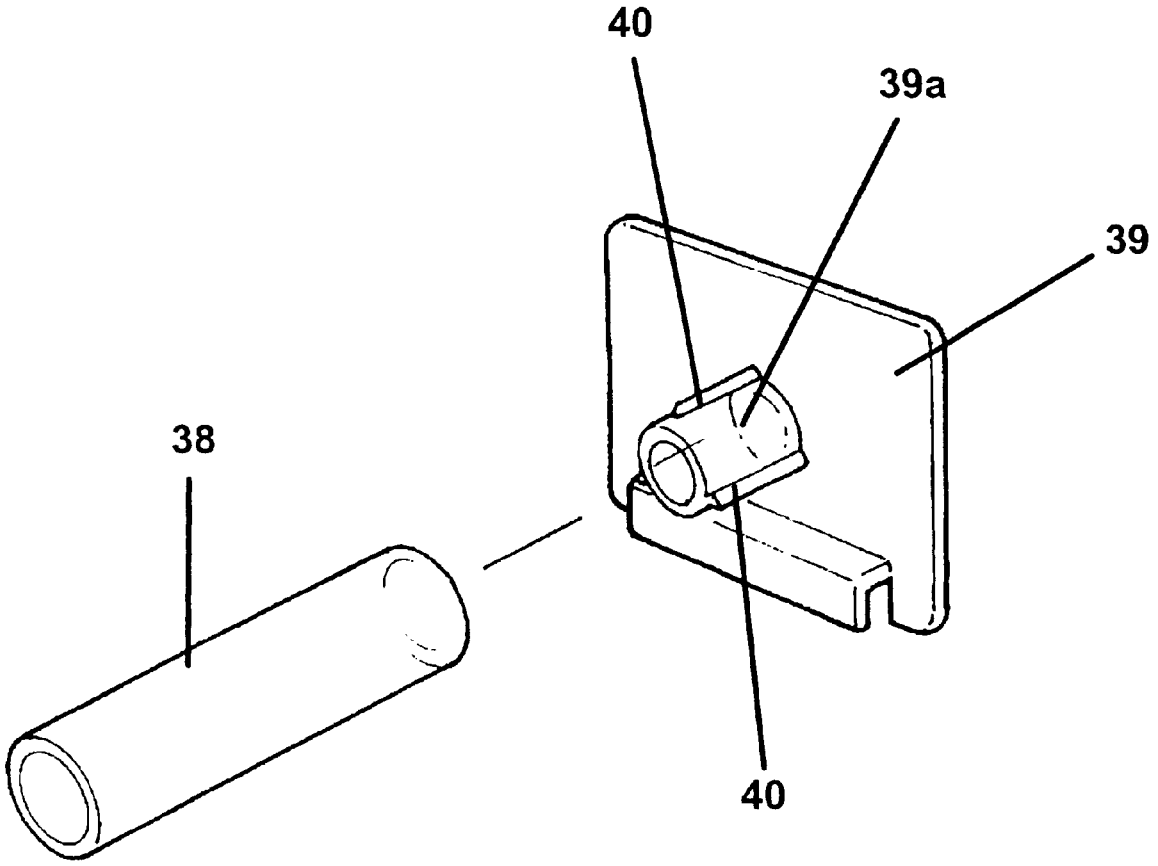
FIG. 4 shows a subcomponent used in suspending the apparatus of the invention.

The mass of the lower portion of apparatus 10 is supported by a rod or tube 38 having at one end a T-profile head 39 and at the other end a foot 41. T-profile head 39 may be formed, when tube 38 is a hollow tube open at at least one end, from a top hat section member, the protruding, cylindrical (non-flanged) part 39*a* of which is inserted into the open end of the tube 38 as shown in FIG. 4. The exterior of cylindrical part 39*a* has formed protruding therefrom a series of elongate ribs 40 that ensure secure retention of part 39*a* within tube 38 when the components are pushed together by hand.

An alternative arrangement is one in which the non-flanged part of the top hat section member is itself a hollow tube that fits over the end of tube 38. T-profile head 39 is receivable in a channel 31 (described below) to allow member 38 to support the display apparatus and space it from, e.g., rail 37. As is visible in FIG. 1, the stems of the L-section members 28, 29 while parallel to one another, are not perpendicular to the rear face of each upstanding member 13, 16. Also the length of the stem of each lower L-section member 29 is longer than the stem of each upper L-section member 28. Consequently each channel 31 is of generally triangular profile, thereby permitting suspending of the apparatus 10 in a range of orientations.

The flange 39*b* of T-profile head 39 is square in the preferred embodiment shown, to assist sliding of flange 39*b* into slot 31. Slot 31 is open at either end to facilitate insertion of the head 39. In FIG. 1, the angle between the planes of the T-profile heads 33, 39 and the upstanding walls 13, 16 is at a maximum, whereby the apparatus 10 is tilted backwards relative to rail 37. This orientation, which is ideal for displaying magazines in a retail environment, is achieved by virtue of a downwardly depending lug 42 formed protruding from the rear face of the flange of T-profile head 39. Lug 42 includes a wall extending downwardly parallel to the flange of T-profile head 39, whereby the lip 43 of L-section member 29 may be sandwiched, on sliding of T-profile head 39 into channel 31, between lug 42 and the flange of member 39. This ensures that the apparatus does not rotate to an orientation other than that shown.

Figure 2:
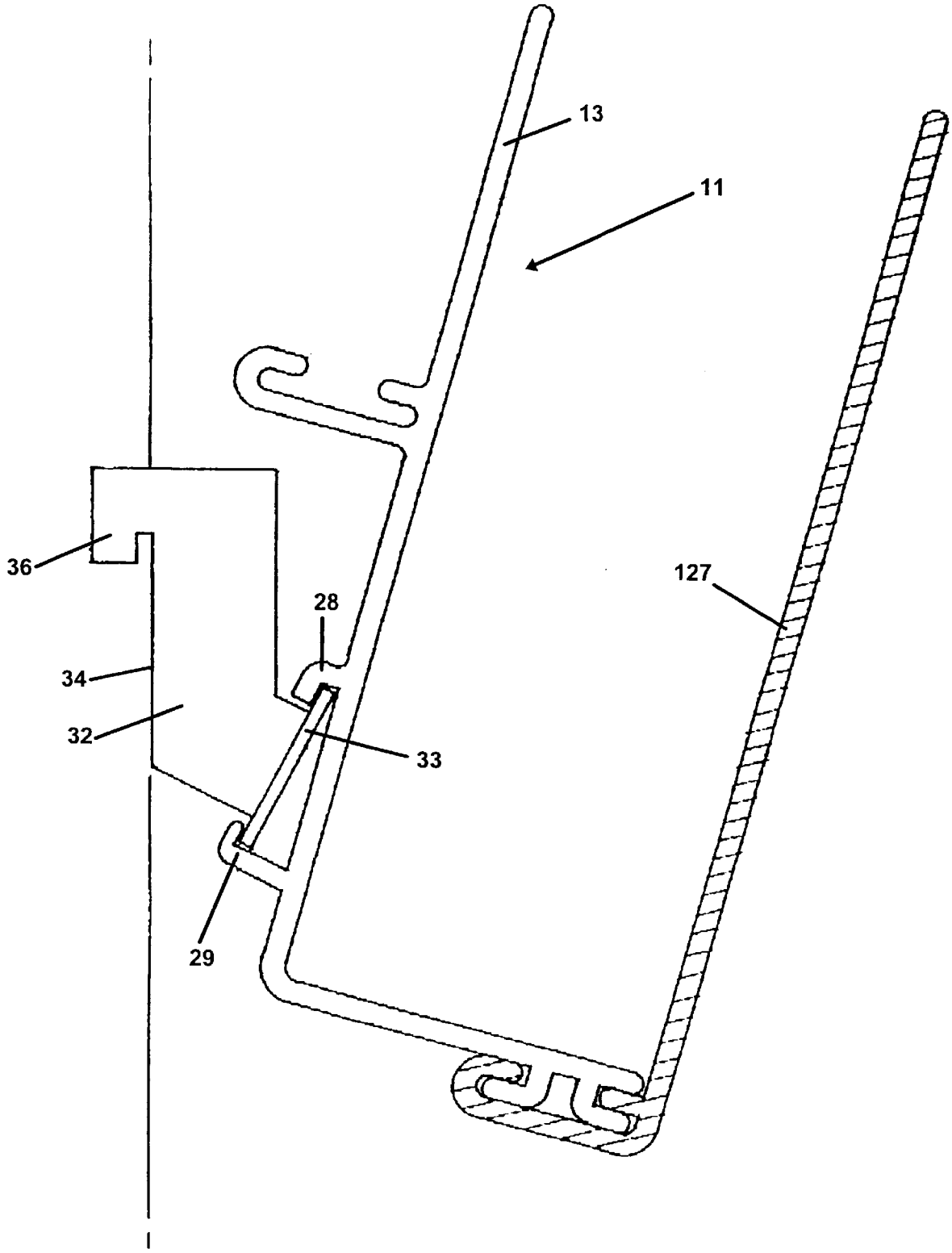
FIG. 2 is an end elevational view of a second embodiment of the invention.

If the heads 33, 39 of the support 32 and rod/tube 38 are angled downwardly relative to rail 37 and lug 42 is slid inside channel 31, the apparatus 10 is suspended at the angle shown in FIG. 2. In the FIG. 2 orientation, it is usually desirable that the channels defined by the upstanding and protruding walls of the modules are U-shaped instead of J-shaped, in order to prevent the articles in the apparatus from flopping forwardly.

FIG. 2 shows how this may be achieved through use of an elongate version 127, of the same height as upstanding wall 13, of the end wall 27 described hereinabove. Although the FIG. 2 arrangement, in which only a single module 11 is terminated by the elongate end wall 127, is within the scope of the invention, in practice there would be one or more of the lower modules 12 suspended beneath module 11 of FIG. 2 before termination of the downwardly extending series by means of wall 127.

In such an arrangement, the upper portions of the lower upstanding walls 16 of the lower modules 12 could, if desired, be similarly elongate in order to achieve the U-shape channel desired in the forwardly tilted embodiment shown.

Variants on the embodiments shown and described herein may include:

- one or more lower upstanding walls 16 that are skewed relative to the upstanding wall of an upper module;
- walls 13 including ornamental features 62 such as printing, embossments, surface textures, recesses and apertures;

non rectilinear free edges 61 of the walls such as walls 13;

transversely extending ribs 60, in the U- or J-shaped channels, that help prevent, e.g., magazines in the display apparatus from slipping forwardly at their lower edges adjacent the bottoms of the channels.

Figure 3:
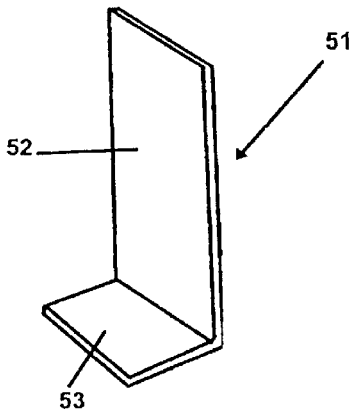
FIG. 3 shows one preferred form of divider in accordance with the invention.
Figure 5:
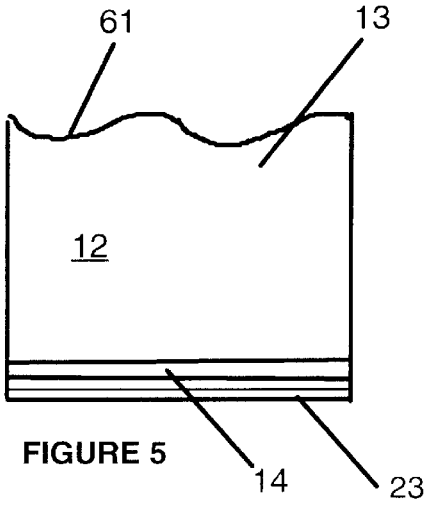
FIG. 5 is a front view of a module with a non-rectilinear wall.
Figure 6:
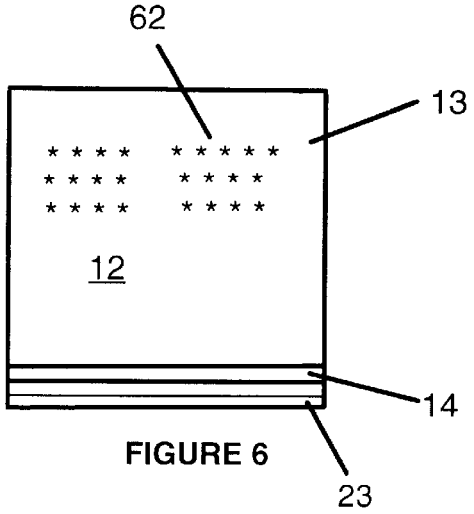
FIG. 6 is a front view of a module with ornamental features on the module.

FIG. 3 shows one form of moveable divider 51 that is insertable into the channel defined by the upstanding walls. Divider 51 includes a laminar upstand 52 that is connected to a laminar foot member 53 to form a generally L-shaped configuration. Divider 51 is dimensioned to fit into the U or J-shaped channels with the upstand uppermost and the foot member 53 slideably moveable along the bottom of the channel. The laminar upstand 52 thus extends upwards, between and generally parallel to the side walls 13 and 16 of the module in which it is positioned. The upstand 52 preferably is approximately the same length as the articles (e.g. magazines) displayed in the apparatus.

Preferably the modules are manufactured from a material such as polycarbonate or acrylic, which may readily be self-colored or transparent, depending on the precise requirements for the display. As is evident from the cross sections shown in the drawing figures, each module may easily be manufactured as an elongate extrusion. Consequently, the manufacture of each module is advantageously quick to achieve. Also, through use of per se known extrusion technology, the quality and integrity of the modules may be assured.

Nonetheless, other methods of manufacturing the modules may of course be employed if desired. If as preferred the modules are manufactured from acrylic or polycarbonate, they may be fabricated from a series of acrylic or polycarbonate panels that can be welded together, e.g. by heat or ultrasound welding. Alternatively the modules of the invention may be manufactured from other plastics materials, from metal, or even from formable natural materials such as timber.

What is claimed is:

1. A modular display apparatus comprising an upper module including an upper upstanding wall and a first protruding wall protruding from the upper upstanding wall; and at least a first, lower module including a lower upstanding wall and a second protruding wall protruding from the lower upstanding wall, the lower upstanding wall and the first protruding wall including mutually engageable connector parts whereby the lower upstanding wall is connectable, at a point below its uppermost edge, to the first protruding wall whereby, on connection of the walls together, the modules define a display apparatus in which a portion of the lower upstanding wall extends above the first protruding wall to define, with the walls of the upper module, a channel, that is open along at least one side, for display and dispensing of articles therein, the connector parts, when mutually engaged, defining a rigid joint whereby the apparatus is self-supporting when assembled; and the rear side of at least the first upper upstanding wall including a pair of mutually spaced, juxtaposed, upper and lower T-slot members extending rearwardly therefrom, the pair of T-slot members defining a support channel for receiving a head, having a T-profile, of a support member for the apparatus, the lower T-slot member protruding from the upper upstanding wall further than the upper T-slot member.

2. A display apparatus according to claim 1 wherein the channel is U-shaped.

3. A display apparatus according to claim 2, wherein the pair of modules include mutually engageable members including a slot; and a member that is slideably receivable in the slot, one of said slot and said member being secured below the upper edge of the rear face of the upstanding wall of a lower said module; and the other of the slot and the member being secured on the underside of an upwardly adjacent said module.

4. A display apparatus according to claim 2 including a further, lower module including a further, lower upstanding wall and a third protruding wall protruding therefrom, the further, lower upstanding wall being connectable, at a point below its uppermost edge, to the second protruding wall wherein, on connection of the second protruding wall and the further, lower, upstanding wall together, a portion of the further, lower, upstanding wall extends above the second protruding wall to define, with the walls of the first, lower module a further channel, that is open along at least one side for display and dispensing of articles therein.

5. A display apparatus according to claim 4, wherein a pair of the modules include mutually engageable members including a slot, and a member that is slideably receivable in the slot, one of said slot and said member being secured below the upper edge of the rear face of the upstanding wall of a lower said module; and the other of the slot and the member being secured on the underside of an upwardly adjacent said module.

6. A display apparatus according to claim 4 including a plurality of the further lower modules supported one beneath another, by virtue of connection of the upstanding wall of each lower module to the protruding wall of the adjacent, higher module, thereby defining a series of the channels one beneath another.

7. A display apparatus according to claim 6, wherein a pair of the modules include mutually engageable members include a slot; and a member that is slideably receivable in the slot, one of said slot and said member being secured below the upper edge of the rear face of the upstanding wall of a lower said module; and the other of the slot and the member being secured on the underside of an upwardly adjacent said module.

8. A display apparatus according to claim 1 including a further, lower module including a further, lower upstanding wall and a third protruding wall protruding therefrom, the further, lower upstanding wall being connectable, at a point below its uppermost edge, to the second protruding wall wherein, on connection of the second protruding wall and the further, lower, upstanding wall together, a portion of the further, lower, upstanding wall extends above the second protruding wall to define, with the walls of the first, lower module a further channel, that is open along at least one side for display and dispensing of articles therein.

9. A display apparatus according to claim 8, wherein a pair of the modules include mutually engageable members including a slot; and a member that is slideably receivable in the slot, one of said slot and said member being secured below the upper edge of the rear face of the upstanding wall of a lower said module; and the other of the slot and the member being secured on the underside of an upwardly adjacent said module.

10. A display apparatus according to claim 8 wherein the lowermost protruding wall terminates in an upwardly extending end wall, defining the front of a lowermost channel that is open along one side.

11. A display apparatus according to claim 8 including a plurality of the further lower modules supported one beneath another, by virtue of connection of the upstanding wall of each lower module to the protruding wall of the adjacent, higher module, thereby defining a series of the channels one beneath another.

12. A display apparatus according to claim 11, wherein a pair of the modules include mutually engageable members including a slot; and a member that is slideably receivable in the slot, one of said slot and said member being secured below the upper edge of the rear face of the upstanding wall of a lower said module; and the other of the slot and the member being secured on the underside of an upwardly adjacent said module.

13. A display apparatus according to claim 11 wherein the lowermost protruding wall terminates in an upwardly extending end wall, defining the front of a lowermost channel that is open along one side.

14. A display apparatus according to claim 1, wherein the pair of modules include mutually engageable members including a slot; and a member that is slideably receivable in the slot, one of said slot and said member being secured below the upper edge of the rear face of the upstanding wall of a lower said module; and the other of the slot and the member being secured on the underside of an upwardly adjacent said module.

15. display apparatus according to claim 14 wherein the lowermost protruding wall terminates in an upwardly extending end wall, defining the front of a lowermost channel that is open along one side.

16. A display apparatus according to claim 14 wherein the mutually engagable members include an essentially T-section member secured to the underside of the protruding wall and a T-slot secured to the rear side of said upstanding wall.

17. A display apparatus according to claim 16 wherein the essentially T-section member is defined by a pair of mutually parallel, elongate, L-section members spaced from one another and each having one limb of its L-section secured to the protruding wall, wherein the other limbs of the respective L-sections diverge from one another.

18. A display apparatus according to claim 17, wherein the T-slot is defined by a first top wall protruding from the rear side of the upstanding wall and, spaced downwardly from the first top wall, a J-section member secured at one end to the upstanding wall such that the free end of the J-section is juxtaposed to and spaced from the first top wall, whereby the straight portion of the J-section defines the base of the T-slot and the said free end defines a second top wall.

19. A display apparatus according to claim 17 wherein the lowermost protruding wall terminates in an upwardly extending end wall, defining the front of a lowermost channel that is open along one side.

20. A display apparatus according to claim 16, wherein the T-slot is defined by a first top wall protruding from the rear side of the upstanding wall and, spaced downwardly from the first top wall, a J-section member secured at one end to the upstanding wall such that the free end of the J-section is juxtaposed to and spaced from the first top wall, whereby the straight portion of the J-section defines the base of the T-slot and the said free end defines a second top wall.

21. A display apparatus according to claim 20 wherein the T-slot is open at at least one end.

22. A display apparatus according to claim 20 wherein the lowermost protruding wall terminates in an upwardly extending end wall, defining the front of a lowermost channel that is open along one side.

23. A display apparatus according to claim 16 wherein the lowermost protruding wall terminates in an upwardly extending end wall, defining the front of a lowermost channel that is open along one side.

24. A display apparatus according to claim 23, wherein the end wall includes protruding therefrom a T-slot slidingly engageable with the essentially T-section member of the lowermost protruding wall.

25. A display apparatus according to claim 1 wherein the lowermost protruding wall terminates in an upwardly extending end wall, defining the front of a lowermost channel that is open along one side.

26. A display apparatus according to claim 25, the support channel of which includes received therein a support member having a T-shaped head, the end of the support member remote from the support being engageable with a surface, thereby to brace the apparatus relative to the said surface.

27. A display apparatus according to claim 26, wherein arms of said T-profile heads are, in use, parallel to the upstanding walls with which they engage.

28. A display apparatus according to claim 26, wherein arms of said T-profile heads are, in use, skewed relative to the upstanding walls with which they engaged, the respective support channels being angled relative to the adjacent upstanding walls.

29. A display apparatus according to claim 1 the support channel of the uppermost module of which has received therein a support member, having a T-profile head, including, at its end remote from the uppermost module, a hook and a reaction surface for supporting the support member, and hence the uppermost module, in cantilever fashion.

30. A display apparatus according to claim 29, wherein arms of said T-profile heads are, in use, skewed relative to the upstanding walls with which they engage, the respective support channels being angled relative to the adjacent upstanding walls.

31. A display apparatus according to claim 29, the support channel of a member of which includes, received therein, a support member having a T-shaped head, the end of the support member remote from the support being engageable with a surface, thereby to brace the apparatus relative to the surface.

32. A display apparatus according to claim 29, wherein arms of said T-profile heads are, in use, parallel to the upstanding walls with which they engage.

33. A display apparatus according to claim 1 wherein the upstanding wall of said lower module is generally parallel to the upstanding wall of the upwardly adjoining module when the modules are connected together.

34. A display apparatus according to claim 1 wherein the upstanding walls of the respective modules are, in use of the apparatus, of generally equal heights.

35. A display apparatus according to claim 34, wherein a free, upper edge of the upstanding walls is non-rectilinear.

36. A display apparatus according to claim 1, wherein at least one of said upstanding walls includes ornamental features.

37. A display apparatus according to claim 1, wherein the interior of at least one of the channels includes a plurality of transversely extending ribs for preventing laminar items from slipping when displayed in the apparatus.

38. A display apparatus according to claim 1, further including a moveable divider located in the channel.

39. A display apparatus according to claim 1 wherein the channel is J-shaped.

40. A display apparatus according to claim 39 wherein the pair of modules include mutually engageable members including a slot; and a member that is slideably receivable in the slot, one of said slot and said member being secured below the upper edge of the rear face of the upstanding wall of a lower said module; and the other of the slot and the member being secured on the underside of an upwardly adjacent said module.

41. A display apparatus according to claim 39, including a further, lower module including a further, lower upstanding wall and a third protruding wall protruding therefrom, the further, lower upstanding wall being connectable, at a point below its uppermost edge, to the second protruding wall wherein, on connection of the second protruding wall and the further, lower, upstanding wall together, a portion of the further, lower, upstanding wall extends above the second protruding wall to define, with the walls of the first, lower module a further channel, that is open along at least one side for display and dispensing of articles therein.

42. display apparatus according to claim 41, wherein a pair of the modules include mutually engageable members including a slot, and a member that is slideably receivable in the slot, one of said slot and said member being secured below the upper edge of the rear face of the upstanding wall of a lower said module; and the other of the slot and the member being secured on the underside of an upwardly adjacent said module.

* * * * *